United States Patent [19]

Han et al.

[11] 4,343,005

[45] Aug. 3, 1982

[54] MICROWAVE ANTENNA SYSTEM HAVING ENHANCED BAND WIDTH AND REDUCED CROSS-POLARIZATION

[75] Inventors: Ching C. Han, Los Altos; Herman W. Bilenko, Santa Clara; Yeongming Hwang, Los Altos, all of Calif.

[73] Assignee: Ford Aerospace & Communications Corporation, Detroit, Mich.

[21] Appl. No.: 220,558

[22] Filed: Dec. 29, 1980

[51] Int. Cl.[3] ..... H01Q 19/14

[52] U.S. Cl. ..... 343/781 P; 343/840; 343/DIG. 2; 343/779

[58] Field of Search ..... 343/756, 786, 840, 781 R, 343/779, 781 P, DIG. 2

[56] References Cited

U.S. PATENT DOCUMENTS

| | | | |
|---|---|---|---|
| 3,271,776 | 9/1966 | Hannan | 343/853 |
| 3,553,706 | 1/1971 | Chareton | 343/777 |
| 3,564,552 | 2/1971 | Fraizer, Jr. | 343/778 |
| 3,599,219 | 8/1971 | Holtum, Jr. | 343/840 |
| 3,680,138 | 7/1972 | Wheeler | 343/756 |
| 3,680,143 | 7/1972 | Ajioka et al. | 343/779 |
| 3,706,998 | 12/1972 | Hatcher et al. | 343/754 |
| 3,790,941 | 2/1974 | Chivers et al. | 343/100 PE |
| 3,811,129 | 5/1974 | Holst | 343/844 |
| 3,864,683 | 2/1975 | Mörz | 343/113 R |
| 3,936,835 | 2/1976 | Phelan | 343/753 |
| 3,940,772 | 2/1976 | Ben-dov | 343/853 |
| 4,090,203 | 5/1978 | Duncan | 343/753 |
| 4,115,782 | 9/1978 | Han et al. | 343/779 |
| 4,122,446 | 10/1978 | Hansen | 343/786 |

*Primary Examiner*—David K. Moore

*Attorney, Agent, or Firm*—Robert K. Stoddard; Edward J. Radlo; Robert D. Sanborn

[57] ABSTRACT

The antenna system employs a parabolic reflector fed by an offset feed array of circular wave guides located substantially at the focus of the parabolic reflector, but offset from the axis thereof. A plurality of aperture tuning mechanisms disposed at the mouths of the circular waveguides of the waveguide feed array, and having physical lengths much shorter than one wavelength at the frequencies involved, are provided to reduce cross-polarization and mutual coupling between adjacent feeds. The short resonant length of these tuning mechanisms, and their shape which is chosen to generate the $TM_{11}$ mode E-field contour line ensures that they are effective over a broad bandwidth of as much as 20% or more. Within this bandwidth, they act as inductive suppressors to control both cross-polarization and mutual coupling between adjacent feeds.

15 Claims, 6 Drawing Figures

MICROWAVE ANTENNA SYSTEM HAVING ENHANCED BAND WIDTH AND REDUCED CROSS-POLARIZATION

BACKGROUND OF THE INVENTION

I. Field of the Invention

The apparatus of this invention is an antenna system useful in satellite-to-ground communications in the microwave frequency spectrum, especially the band around 4 gHz. Antenna systems of the general type under consideration have been in use for many years and consist principally of a waveguide feed array facing toward a parabolic dish reflector and located at the focus thereof but offset from the principal axis of the reflector. In the transmit mode the waveguide feed array propagates microwave energy through the short region of space to the parabolic reflector from which it is reflected into a propagating beam of desired shape directed toward a selected region on Earth. Similarly, signals beamed toward a satellite and received by the reflector dish in the proper orientation thereto can be directed toward the waveguide array for reception. The satellite with which such antenna systems are used can be provided with solar collectors and batteries for continuously supplying power, and with the requisite electronics to turn the antenna system into a complete reception and transmission station for repeater or other purposes. By suitably shaping the beam pattern of the antenna system, widely separated zones on the face of the Earth can be placed in excellent mutual communication with one another through the medium of the satellite which acts as a repeater.

Because the use of such communication satellites has become so accepted for a wide variety of purposes ranging from the transmission of entertainment programs to uses in ground surveillance and meteorological data gathering, it has become desirable in recent years to expand the number of communication channels which can be handled by a single antenna system. In the past, a 10% bandwidth has been considered adequate for such antenna systems, although wider bandwidth would, of course, permit the accommodation of more communications channels per satellite.

II. Description of the Prior Art

U.S. Pat. No. 4,115,782 issued Sept. 19, 1978, having common assignment with the present application and including a common coinventor therewith, describes a microwave antenna system of the general type outlined above which successfully propagated over a 10% bandwidth and maintained excellent rejection of interfering cross-polarization. Although this performance was considered excellent at the time of this earlier patent, recent developments and increased demands have required that the bandwidth be further increased to the maximum permissible, i.e., 20%.

Studies made to determine the feasibility of extending the bandwidth of the prior art device of the above patent to 20% produced the result that such bandwidth extension could be obtained only at the expense of a considerable degradation of performance, especially with respect to maintaining low cross-polarization. Further studies indicate that a considerable alteration of the feed array would be necessary in order to secure the desired bandwidth while maintaining low cross-polarization.

The antenna systems of U.S. Pat. No. 4,115,782 utilized a closely packed feed array consisting of square wave guides. While this feed array performed admirably over a 10% bandwidth and provided excellent gain because of the close packing possible when using a square or rectangular cross-section for the individual waveguides, the researches which led to the present invention disclosed that such a waveguide array was incapable by any known means of providing both the bandwidth and cross-polarization performance desired.

U.S. Pat. No. 4,090,203 to James W. Duncan issued May 16, 1978, and covers various antenna systems of the general type under consideration wherein an offset feed array is employed with a generally paraboloidal reflector. The Duncan patent employs circular waveguides as feed elements arrayed in a variety of configurations as disclosed in his FIGS. 11–15, but does not deal with the critical problems involved in extending bandwidth beyond that which was routinely achieved in the prior art systems existant at the time of the Duncan device. Duncan's patent is principally concerned with techniques to enhance the suppression of side lobes to thereby secure a more nearly Gaussian distribution of energy in the beam.

U.S. Pat. No. 3,790,941 to Malcom Chivers et al, deals with an antenna tracking system employing a single circular waveguide together with a polarizer and a rectangular-to-circular transition. However, Chivers et al does not deal with the problems associated with enhancing bandwidth while maintaining low cross-polarization in a multiple feed array such as found in the present invention. Consequently, there are no teachings to be found within Chivers et al as to the proper arrangement of such a feed array, or as to how to overcome problems of cross-polarization and mutual coupling when such an array is provided.

U.S. Pat. No. 3,936,835 to Harry Richard Falin concerns feed systems for multiple beam antennas in which arrays of circular waveguides of different configurations are shown. However, no means are illustrated or described in this patent for securing the broad bandwidth and low cross-polarization achieved by the means of the present invention.

U.S. Pat. No. 4,122,446 to Lawrence H. Hanson illustrates a type of transition in circular wave guide consisting of a step segment 12 for achieving transition with minimum reflection loss and VSWR. However, the patent contains nothing else instructive in the arts of the present invention.

U.S. Pat. No. 3,864,683 to Gunter Mörz is directed to an automatic direction finding system for orienting a microwave antenna and is unrelated to the concerns of the present invention except for its inclusion of a coax-to-waveguide coupler and a square-to-circular transition for use in waveguide systems.

U.S. Pat. No. 3,680,138 to Harold A. Wheeler illustrates a means of mode control in a multiple array of circular waveguides including a cross-mode reflector 7 which is claimed to provide linear polarization even though the apertures of the waveguides are circular.

The following U.S. Pat. Nos. are cited as of general background interest in an evaluation of the present invention:

U.S. 3,940,772 issued Feb. 24, 1976
U.S. 3,811,129 issued May 14, 1974
U.S. 3,271,776 issued Sept. 6, 1966
U.S. 3,553,706 issued Jan. 5, 1971
U.S. 3,564,552 issued Feb. 16, 1971
U.S. 3,706,998 issued Dec. 19, 1972

SUMMARY OF THE INVENTION

The present invention overcomes the bandwidth limitations of the prior art while preserving a high degree of cross-polarization rejection in part by employing an array of circular waveguides as a feed element for a microwave antenna system. The waveguides may be arrayed in multiples of seven, such that six of the wave guides form either an isosceles lattice, or an equilateral lattice about the central waveguide.

Securing the desired broad band low cross-polarization performance is further made possible in the present invention by use of aperture tuning means in the form of a plurality of inductive stubs equispaced about the perimeter of the apertures of the waveguides. These inductive stubs act to limit cross-polarization and to reduce mutual coupling between adjacent guides.

The inductive stubs are dimensioned to be short in comparison with a wavelength at the frequency concerned, and to have a cross-sectional shape which conforms closely with the E-field contour line of the dominant propagating mode in the guides ($TE_{11}$) such that their tuning effect extends fully over the bandwidth desired.

BRIEF DESCRIPTION OF THE DRAWINGS

The above and other detailed and specific objects, features, and advantages of the present invention will become clearer from a consideration of the following detailed description of a preferred embodiment, and a perusal of the associated drawings, in which.

DETAILED DESCRIPTION OF A PREFERRED EMBODIMENT

Figure 1:
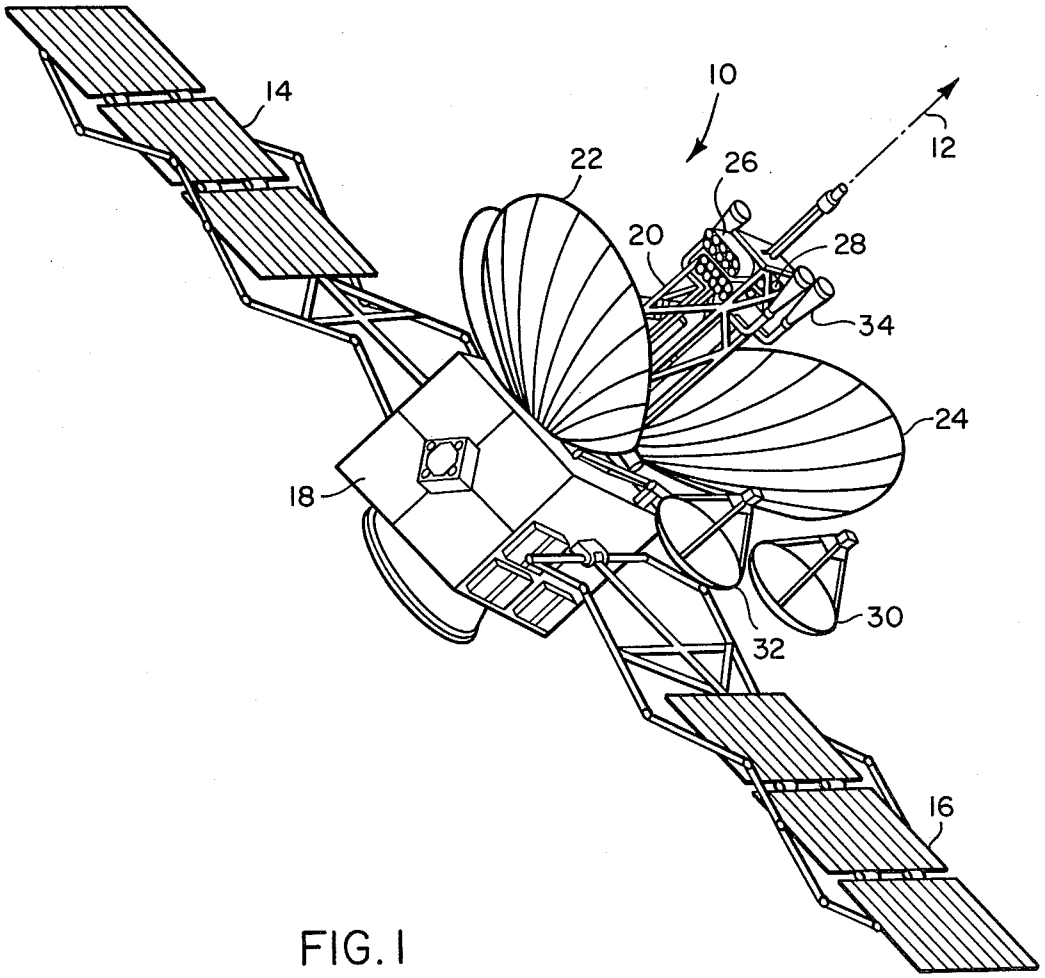
FIG. 1 is a perspective view of a satellite spacecraft utilizing the microwave antenna system of the present invention.

In FIG. 1, a satellite spacecraft 10 is pictured as it might appear in orbit above the earth. If the angular orbital velocity of satellite 10 is made equal to the angular velocity of the Earth rotating on its axis, satellite 10 will remain in a fixed angular orientation with respect to the geographical features of the surface of the Earth such that it may remain in constant radio communication with selected areas of the surface of the Earth. In the description which follows, it may be assumed that satellite spacecraft 10 is so oriented with respect to the surface of the Earth that a line drawn through the center of the Earth and spacecraft 10 would intercept the surface of the Earth approximately in the middle of the Atlantic Ocean. In such an orientation, line-of-sight communication may be established between satellite spacecraft 10 and a nearly-hemispherical "viewable" portion of the Earth which includes Canada, the United States, Latin America, and South America in the western portion of the hemisphere. In the eastern portion of this "viewable" hemisphere are found the continents of Europe and Africa, portions of the U.S.S.R., etc. As will be readily realized, by repositioning the satellite 10, virtually any two points located less than a hemisphere from one another on the surface of the Earth may be placed into electromagnetic communication by satellite spacecraft 10.

A pair of solar arrays 14 and 16 are shown in FIG. 1 in a deployed position extending to either side of satellite 10 to receive solar energy and provide electrical power for satellite 10. Spacecraft body portion 18 typically contains guidance, attitude control, propulsion, energy storage, and communications equipment. A tower assembly 20 and a pair of offset elliptical parabolic reflectors 22 and 24 are connected to body portion 18. Parabolic reflectors 22 and 24 may have different aperture projection diameters as illustrated in FIG. 1, where the diameter of reflector 22 is less than the diameter of reflector 24.

Offset parabolic reflector 22 is a portion of the surface of a paraboloid having a focal point in the vicinity of tower 20. A waveguide element array 26 is mounted on tower 20 and positioned and oriented with respect to reflector 22 so as to receive therefrom microwave radiation, or to propagate such microwave radiation to reflector 22. Because waveguide element array 26 is positioned at a location offset from a line drawn between reflector 22 and the portion of the surface of the Earth with which satellite 10 is in electromagnetic communication, tower 20 and array 26 do not interfere with radiation transmitted between Earth and reflector 22.

Opposite array 26 on tower 20 is a second waveguide element array 28, similar to array 26 but possibly of a different waveguide dimension to accommodate a different band of frequencies. Array 28 is positioned to be in communication with reflector 24 to transmit and to receive therefrom electromagnetic radiation.

In practice, waveguide element array 26 and its associated reflector 22 may be used to transmit and receive electromagnetic signals from Earth. However, within the context of this patent application the invention will be described from the standpoint of transmission from satellite 10 to the Earth's surface.

Figure 2:
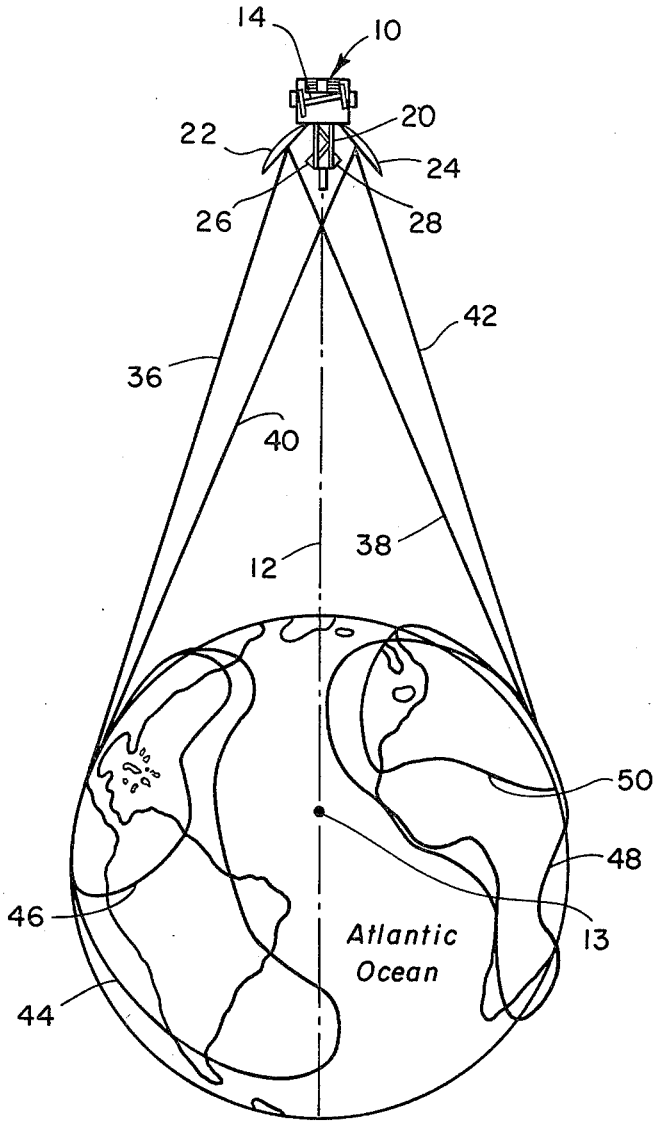
FIG. 2 is a diagrammatic view illustrating the satellite in position above the Earth.

In FIG. 2, satellite 10 is shown utilizing a receiving antenna system which might comprise waveguide element feed array 26 and associated reflector 22, and as a satellite transmitting antenna, waveguide element feed array 28 and associated reflector 24. FIG. 2 illustrates the relative positioning of satellite 10 with respect to the Earth when the satellite is directly over a point in the Atlantic Ocean, as indicated by the showing of an axis 12 passing through satellite 10 and the center of the Earth, intersecting the surface of the earth at a point 13 in the Atlantic Ocean.

Diagramatically illustrated in FIG. 2 is the "viewable" hemisphere of the Earth as it is "seen" by satellite 10 in an electromagnetic-communication sense. To the left in FIG. 2, corresponding with the aforementioned positioning of satellite 10 over the position in the Atlantic Ocean, are the North and South American continents. On the right of the viewable hemisphere are the European and African continents. Lines 36 and 38 have been drawn from the antenna system, which includes offset reflector 22, to the edges of the viewable hemisphere indicating the full extent of the region accessible by this antenna system of the satellite. Similarly, lines 40 and 42 define the transmission region for the antenna system of satellite 10 which includes offset reflector 24.

A western-hemisphere antenna transmission pattern 44 and a second, smaller, transmission pattern 46 are illustrated in FIG. 2. These patterns illustrate the strong-signal regions, disregarding sidelobe radiation, and could be provided by appropriate design of associated elements 28 and 24 to shape the transmitted beam as required. Although a large transmission pattern such as 44 could thus be secured quite easily, in practice it is often preferred to provide a smaller pattern such as pattern 46, in order to secure enhanced signal strength in the most populous and congested regions such as along the Atlantic seaboard of the North American continent and in the Latin American and northern South American regions. Similarly, in the eastern hemisphere, the satellite transmission system formed by components 28 and 24 may be used to provide radiation patterns illustrated as 48 or 50, the former again being larger than the latter and covering the entire European and African continents. The smaller area 50 covers only the European and north African region.

In addition to the principal transmission areas indicated as 44, 46, 48 and 50 in FIG. 2, the antenna does radiate sidelobe patterns which are not illustrated in FIG. 2. The sidelobe patterns, however, can be so successfully suppressed by careful antenna design as to permit for example reuse in the respective hemispheres of a given frequency channel. It is possible to use the same frequency channel simultaneously to produce the separate radiation patterns 44 and 46, or 48 and 50 without introducing interference between the radiation patterns. In particular, it is possible to produce at the same frequency of 4 gHz, for example, a relatively high intensity signal having lefthand circular polarization within the area covered by pattern 46, while at the same time producing a 4 gHz signal of lesser intensity within the area covered by pattern 44. However, in order to do this, it is necessary to provide excellent rejection of cross-polarization in the design of the antenna system. For example, to provide an isolation between the two differently polarized signals of 27 dB which may be considered an acceptable standard, a voltage axial ratio of less than 1.09, which is equivalent to less than 0.75 dB, must be secured in the antenna design.

In the apparatus of the aforementioned U.S. Pat. No. 4,115,782, such performance levels were attained over a frequency band of over 10%. However, when attempts were made to extend this frequency band to 20%, the discovery was made that no known means could secure the low levels of cross-polarization required. Consequently, a series of studies was initiated, resulting in the apparatus of the present invention. In particular, it was discovered that the square-waveguide array of U.S. Pat. No. 4,115,782 could not support the low cross-polarization levels required over a 20% band width.

Figure 3:
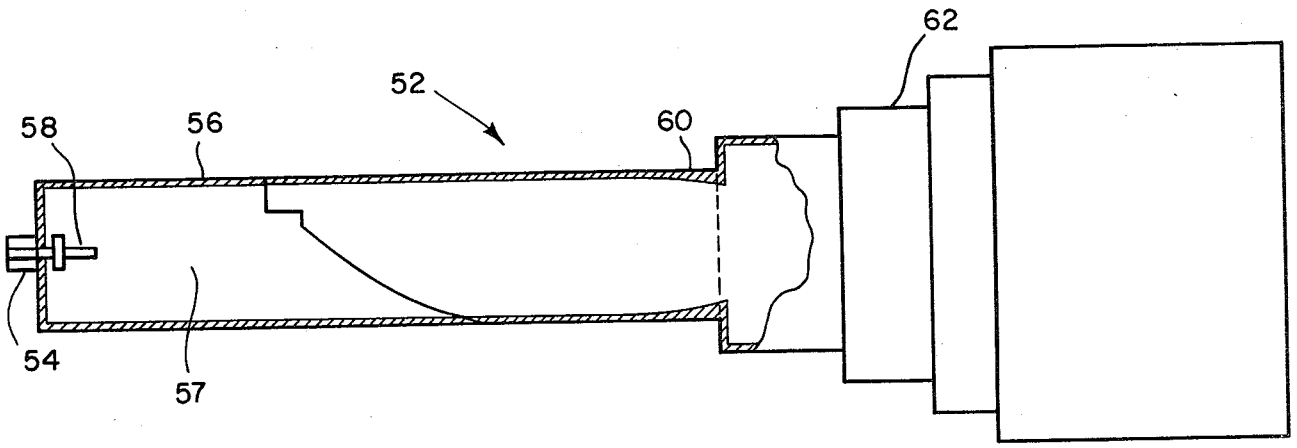
FIG. 3 is a side view, partially in section, of a waveguide element according to the present invention.

Turning now to FIG. 3, there is shown a novel waveguide element 52 of the waveguide element array 26 in accordance with the present invention. Waveguide element 52 includes at the left end thereof a coaxial-line-to-waveguide coupler 54 which may be of the type which is the subject of patent application Ser. No. 732,688 filed Oct. 15, 1976 and entitled "Apparatus for Coupling Coaxial Transmission Line to Rectangular Waveguide", now U.S. Pat. No. 4,071,833 and which is commonly assigned with the present application. Coupler 54 is used to couple energy between a coaxial line (not shown) attached to the leftmost end of coupler 54 in FIG. 3, and a square waveguide 56. In particular, such coupling is accomplished by coupler 54 with minimum discontinuity and reflection loss. Within waveguide 56 is disposed a septum polarizer 58 which may be for example the same as the septum polarizer which forms the subject of patent application Ser. No. 808,206 filed June 20, 1977 and entitled "Balanced Phase Septum Polarizer", an application commonly assigned with the present one, now U.S. Pat. No. 4,126,835.

Linearly polarized microwave signals are transferred to waveguide 56 by a hook-shaped conductor 58 of coupler 54. Septum polarizer 58 then transforms these linearly polarized microwave signals to a first microwave signal having left-hand circular polarization, and a second microwave signal having right-hand circular polarization. The first and second microwave signals are propagated to the right in FIG. 3, along waveguide 56 to a square-to-circular waveguide transition 60 which propagates the signals further into a circular-guide step transformer 62. Transformer 62 achieves a transition from a relatively small diameter circular guide of short length at its input end, through a series of steps of increasing diameter to an output circular waveguide section 64 of a larger diameter which may be, for example, 1.20 times the centerband wavelength of the frequency band under consideration.

Figure 4:
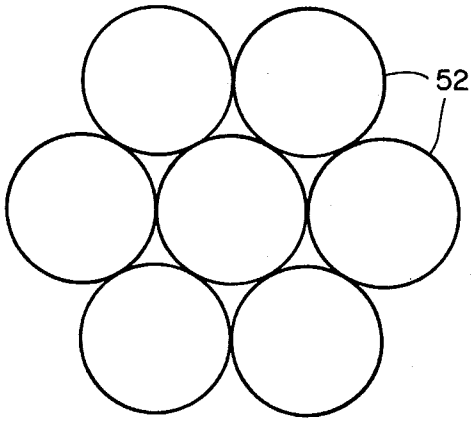
FIG. 4 is an end view illustrating one embodiment of a feed array according to the invention.

In FIG. 4 is shown a waveguide feed array consisting of seven of waveguide elements 52. As shown in FIG. 4, waveguide elements 52 are arrayed so as to be contiguous with one another and to form a compact hexagonal array which minimizes the space between waveguide elements 52 since this space is "dead" in a microwave sense, i.e., not available for energy transmission. Since any three waveguide elements 52 of the array lie on the corners of identical equilateral triangles, the array is known as an equilateral lattice array. Although as noted, such an array yields the minimum possible "dead" space between waveguides and hence the highest possible gain through close packing, other arrangements are equally possible, such as arranging the waveguide elements on the corners of isosceles triangles or in a simple rectilinear pattern.

Although the feed array shown in FIG. 4 worked fairly well over the desired 20% band width, it was discovered that polarization purity of the feed array as shown in FIG. 4 was still inadequate and resulted in an axial ratio of approximately 5 dB. A series of computer simulations and actual measurements for different frequencies within the desired band and for different angles from the axis of the array revealed the truncation of high order modes resulting from the necessity to choose a small aperture size (less than 1.3 wavelengths) prevented the equalization of E- and H-plane radiation patterns over the intended illuminated region of the reflector.

Figure 5:
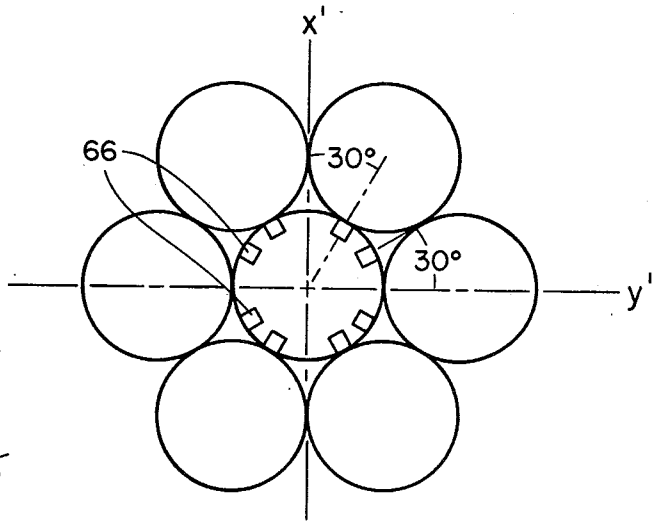
FIG. 5 is an end view illustrating a further embodiment of a feed array according to the invention.
Figure 6:
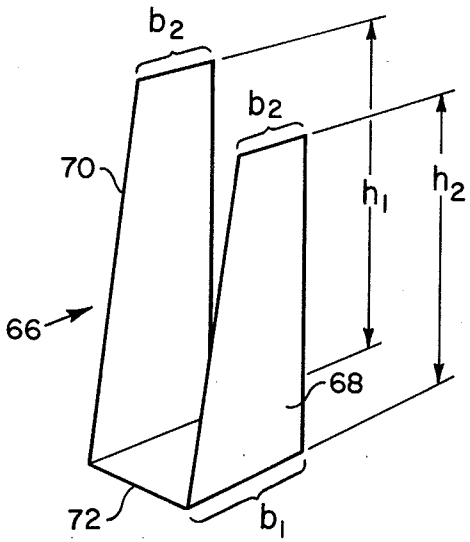
FIG. 6 is an isometric perspective view of one embodiment of an inductive stub useful in the feed array of FIG. 5.

In FIG. 5 is shown, according to the present invention, a waveguide feed array which overcame these problems and resulted in attainment of the desired low cross-polarization through the bandwidth of 20% and over the entire solid angle subtended by the reflector at the feed array. A plurality of inductive stubs 66 are disposed about the apertures of each of the individual waveguide elements of the feed array in order to tailor and successfully control mutual coupling between adjacent waveguide elements of the array. Although, for the sake of clarity, stubs 66 have been illustrated in FIG. 5 disposed only about the aperture of the center waveguide element, it is to be understood that in practice such stubs would be disposed about each waveguide-element aperture in the array. Similarly, although a simple array comprising only seven waveguide elements has been illustrated, it is to be understood that in practice many more waveguide elements might be used, depending on the beam width desired.

The number and arrangement of the inductive stubs has to be somewhat empirically adjusted to provide the optimum amount of mutual coupling between adjacent feeds of the array, resulting in the greatest reduction of axial ratio, and a corresponding improvement in cross-polarization isolation with the disposition of eight inductive stubs 66 as shown in FIG. 5. As can be seen in FIG. 5, the optimum arrangement of the eight inductive stubs 66 is at positions located 30 degrees away from the principal axes x' and y' of the array, where x' is aligned with the axis of propagation of energy from satellite 10 toward Earth, and y' is orthogonal thereto. Although, as noted, such a number and arrangement of stubs 66 has been found to be optimum, fairly good results have also been obtained by utilizing four stubs equispaced about each aperture, and either in alignment with the principal axes or in a diagonal orientation, 45 degrees away from the principal axes.

Finally, it was discovered that the shape of inductive stubs 66 needed to be carefully and empirically adjusted to achieve optimum performance after the selection of their number and arrangement had been made. Turning now to FIG. 7, the optimum shape and dimension for each of inductive stubs 66 is shown to comprise a shorter inner leg 68 of trapezoidal configuration, and a longer outer leg 70 also of trapezoidal shape. Legs 68 and 70 are joined by a root portion 72. The optimum shapes of legs 68 and 70 has been found empirically to result from the choice of a tip width $b_1$ in the range of 55% to 75% of the width $b_2$ of root portion 72, with the optimum being $\frac{2}{3}$ or 68%. The relative length of legs 68 and 70 is optimum when $h_1$ is 105% to 120% of $h_2$, with the absolute optimum occurring when $h_1$ is 112% of $h_2$. Stubs 66 may be made of copper and may be mounted as by brazing outer leg 70 to the inner surface of each waveguide aperture.

With the above optimum arrangement and dimensioning of stubs 66, the desired 20% bandwidth in a 4 gHz antenna array was achieved with less than 1 dB axial ratio, resulting in excellent polarization isolation.

Although the invention has been described with some particularity in reference to a single embodiment which comprises the best mode contemplated by the inventors for carrying out their invention, it will be realized by those skilled in the art that many modifications could be made and many apparently different embodiments thus derived without departing from the scope of the invention. Consequently, the scope of the invention is to be determined only from the following claims.

What is claimed is:

1. A microwave antenna system for producing when energized by a source of microwave signals, first and second simultaneously propagating beams of microwave radiation, said first beam being of left-hand circularly polarized radiation, said second beam being of right-hand circularly polarized radiation, comprising in combination:

a curvilinear microwave-reflective surface defining a focal region within which parallel beams of microwave electromagnetic radiation impinging on said surface are brought to focus;

and disposed within said focal region, a microwave feed array, said feed array comprising a plurality of waveguide feed elements disposed mutually adjacent to one another and commonly aligned to propagate microwave energy toward, and receive microwave energy from said reflective surface, each of said waveguide feed elements comprising a circular waveguide terminating in a circular aperture facing toward said reflective surface;

and disposed about each of said circular apertures, inductive tuning means to selectively reduce mutual coupling between said adjacent feed elements, and to minimize cross-polarization between adjacent feed elements, whereby adjacent feed elements can be energized with signals of alternate polarization sense while substantially avoiding cross-polarization;

said inductive tuning means comprising an inductive stub of generally U-shape, including a first leg, a second leg spaced from said first leg and generally parallel thereto, and a root portion extending between and interconnecting said first and second legs, at least one of said legs being of trapezoidal shape, having a greater width near the portion thereof adjacent said root portion and a lesser width at a tip portion thereof.

2. The antenna system of claim 1 wherein said waveguide feed elements are disposed in a closely packed hexagonal array.

3. The antenna system of claim 2 wherein said waveguide feed elements are disposed such that any three adjacent elements lie on the corners of an equilateral triangle.

4. The antenna system of claim 1 wherein said inductive tuning means comprises a plurality of said inductive stubs disposed spaced about each of said feed element apertures.

5. The antenna system of claim 4 wherein said inductive stubs are disposed at positions azimuthally spaced from the principal axes of said feed array, wherein said principal axes are defined as: (a) a first principal axis aligned with the direction of microwave energy propagation from said microwave antenna system; and (b) a second principal axis orthogonal to said first principal axis.

6. The antenna system of claim 5 wherein said inductive stubs are eight in number and are disposed at positions spaced 30 degrees from said principal axes.

7. The antenna system of claim 1 wherein said inductive stub is mounted in said circular waveguide with said root portion within said circular aperture and said legs projecting axially from said circular aperture.

8. The antenna system of claim 7 wherein said first leg is longer than said second leg and wherein said stub is mounted with said first leg in contact with said waveguide wall.

9. The antenna system of claim 8 wherein each of said legs is of trapezoidal shape, having a width $b_1$ adjacent said root portion and being tapered to a width $b_2$ at a tip end of each said leg, such that $0.55 \leqq b_2/b_1 \leqq 0.75$.

10. The antenna system of claim 9 wherein $b_2/b_1 = \frac{2}{3}$.

11. The antenna system of claim 8 wherein the length of said first leg is $h_1$, the length of said second leg is $h_2$, and $1.05 \leqq \{h_1/h_2\} \leqq 1.20$.

12. The antenna system of claim 11 wherein $h_1/h_2 = 1.12$.

13. A microwave feed array for propagating microwave energy toward, and receiving microwave energy from, a microwave reflective surface, comprising a plurality of circular waveguide feed elements disposed mutually adjacent to one another and axially in alignment with one another along the axis of microwave energy propagation of said array, each of said circular waveguides terminating in a circular aperture, said circular apertures lying generally in a plane orthogonal to said axis of microwave energy propagation, and a plurality of generally U-shaped inductive tuning stubs disposed within and projecting from each of said apertures, each of said inductive stubs having an outer leg in contact with an inner wall of said waveguides, an inner leg generally parallel to said outer leg, and a root portion joining said inner and outer legs within said aperture, said inner and outer legs each being tapered from a width $b_1$ at said root portion to a width $b_2$ at the tip of each of said legs, where $b_1 > b_2$, said outer legs each having a length $h_1$, said inner legs each having a length $h_2$, where $h_1 > h_2$.

14. The microwave feed array of claim 13 where $0.55 \leqq \{b_2/b_1\} \leqq 0.75$, and $1.05 \leqq h_1/h_2 \leqq 1.20$.

15. The microwave feed array of claim 14 designed for operation at frequencies generally in the region around 4 gHz, wherein $b_1$ is substantially 0.6 inches, $b_2$ is substantially 0.4 inches, $h_1$ is substantially 1.8 inches, and $h_2$ is substantially 1.6 inches.

* * * * *